United States Patent [19]

Morishita

[11] Patent Number: 4,467,306

[45] Date of Patent: Aug. 21, 1984

[54] HIGH VOLTAGE CURRENT TRANSFORMER HAVING COILS IMMERSED IN DIELECTRIC FLUID

[75] Inventor: Hikozo Morishita, Kobe, Japan

[73] Assignee: Mitsubishi Denki Kabushiki Kaisha, Tokyo, Japan

[21] Appl. No.: 452,053

[22] Filed: Dec. 22, 1982

[30] Foreign Application Priority Data

Dec. 23, 1981 [JP] Japan ..... 56-192021[U]

[51] Int. Cl.[3] ..... H01F 27/10

[52] U.S. Cl. ..... 336/58; 336/55; 336/60; 336/62

[58] Field of Search ..... 336/55, 58, 60; 174/14 R, 15 R

[56] References Cited

U.S. PATENT DOCUMENTS

| | | | |
|---|---|---|---|
| 3,299,383 | 1/1967 | Conner et al. | 336/58 X |
| 3,611,227 | 10/1971 | Trabut | 336/62 |
| 3,686,598 | 8/1972 | Ozawa et al. | 336/58 |

FOREIGN PATENT DOCUMENTS

| | | | |
|---|---|---|---|
| 1055075 | 4/1959 | Fed. Rep. of Germany | 336/58 |
| 43-3129 | 5/1968 | Japan . | |
| 178837 | 12/1933 | Sweden | 336/58 |
| 548394 | 10/1942 | United Kingdom | 336/58 |

*Primary Examiner*—J. V. Truhe
*Assistant Examiner*—Susan Steward
*Attorney, Agent, or Firm*—Wenderoth, Lind & Ponack

[57] ABSTRACT

A current transformer including a tubular electrically conducting member of a circular cross section connected to one end of a primary winding in the form of a tubular electrically conducting coil having a single turn, a cruciform conducting member coaxially disposed within the tubular member to be connected to the other end of the coil, and a hollow cylindrical dielectric member coaxially disposed within the tubular member to form an incoming and an outgoing flow path between the tubular and dielectric members and between the dielectric and cruciform members, respectively. The tubular coil and the tubular member are wrapped in an insulating member and a secondary winding is wound around the primary winding through the insulating member. The transformer is immersed in a dielectric fluid a part of which fills the two flow paths and the interior of the primary winding communicating with them.

3 Claims, 2 Drawing Figures

HIGH VOLTAGE CURRENT TRANSFORMER HAVING COILS IMMERSED IN DIELECTRIC FLUID

BACKGROUND OF THE INVENTION

This invention relates to a high tension-strong current transformer immersed in a dielectric fluid such as an electrically insulating oil.

A conventional current transformer of the type referred to has previously comprised a primary winding in the form of a tubular electrically conducting coil which forms a single turn enclosed with an electrically insulating member and a secondary winding in the form of a tubular electrically conducting coil electromagnetically coupled to the primary winding through the electrically insulating member. The primary winding includes a pair of lead-in wires consisting of a pair of coaxial tubular electrically conducting members connected to both ends thereof respectively to form an incoming and an outgoing flow path for a dielectric fluid such as an electrically insulating oil communicating with the interior of the primary coil. An outer one of the coaxial tubular members has been enclosed with an extension of the electrically insulating member for the primary coil.

Then the primary and secondary windings have been immersed in the dielectric fluid within an enclosing housing while the flow paths and the interior of the primary coil are filled with the dielectric fluid.

In operation the primary winding has generated heat and particularly an inner one of the coaxial tubular member has been thermally affected by the outer tubular member to be higher in temperature than the outer tubular member, resulting in the occurrence of a difference in temperature of the electrically insulating oil between the outgoing flow path within the inner tubular member and the incoming flow path between the outer and inner tubular members. Thus that portion of the oil located in the outgoing flow path has ascended therealong until it is delivered to the upper portion of the housing through the upper end of the inner tubular member. On the upper portion of the housing, the electrically insulating oil at an elevated temperature has dissipated its heat to the air through a peripheral wall thereof to be cooled. The cooled oil has then descended along the incoming flow path to reach the primary coil, thereby to cool the latter.

Under these circumstances, the funnel effect is caused from both an ascending stream of the electrically insulating oil flowing along the outgoing flow path and the total length of incoming and outgoing flow paths to perform the thermal syphon operation with the result that the primary winding continues to be cooled.

However the thermal syphon operation exhibits the effect affected by the heat exchange between the primary winding and the electrically insulating oil to be proportional to an area over which the heat exchange is effected. This means that, with the incoming and outgoing flow paths formed of the pair of coaxial tubular members, the area of heat exchange between the inner tubular member and the electrically insulating oil has, as a matter of course, a limitation as to the dimension. Thus, if it is attempted to apply a primary winding with the pair of coaxial tubular members as described above to a current transformer operated with higher currents, it has been required to render the area of heat exchange of the inner tubular member sufficiently large, which is attended with the outer tubular member large in outside diameter. Consequently, the current transformer itself has been large, resulting in the disadvantage that it is economically unfavorable.

Accordingly, it is an object of the present invention to provide a new and improved current transformer having an excellent cooling effect by increasing the area of heat exchange as much as possible without increasing the size of the primary winding as a whole.

SUMMARY OF THE INVENTION

The present invention provides a current transformer comprising a housing, an amount of a dielectric fluid disposed in the housing, a primary winding in the form of a tubular electrically conducting coil including a single turn, an outer tubular electrically conducting member connected to one end of the coil, an inner electrically conducting member different in cross-sectional profile from the outer tubular electrically conducting member (noncircular) and coaxially disposed within the outer tubular electrically conducting member to be connected to the other end of the coil, a hollow cylindrical dielectric member coaxially disposed within the outer tubular electrically conducting member to surround the inner electrically conducting member to form an incoming flow path for the dielectric fluid between the outer tubular electrically conducting member and the hollow cylindrical dielectric member and an outgoing flow path for the dielectric fluid between the hollow cylindrical dielectric member and the inner electrically conducting member, respectively, the incoming and outgoing flow paths communicating with each other through the interior of the tubular coil, an electrically insulating member for wrapping the primary winding and the outer tubular electrically conducting member, and a secondary winding in the form of a solenoid magnetically interlinked with the primary winding through the electrically insulating member, the current transformer being immersed in the dielectric fluid while the incoming and outgoing flow paths and the interior of the primary winding are charged with the electrically insulating member.

Preferably, the inner electrically conducting member may have a cruciform cross section.

BRIEF DESCRIPTION OF THE DRAWING

The present invention will become more readily apparent from the following detailed description taken in conjunction with the accompanying drawing in which.

DESCRIPTION OF THE PREFERRED EMBODIMENT

Figure 1:
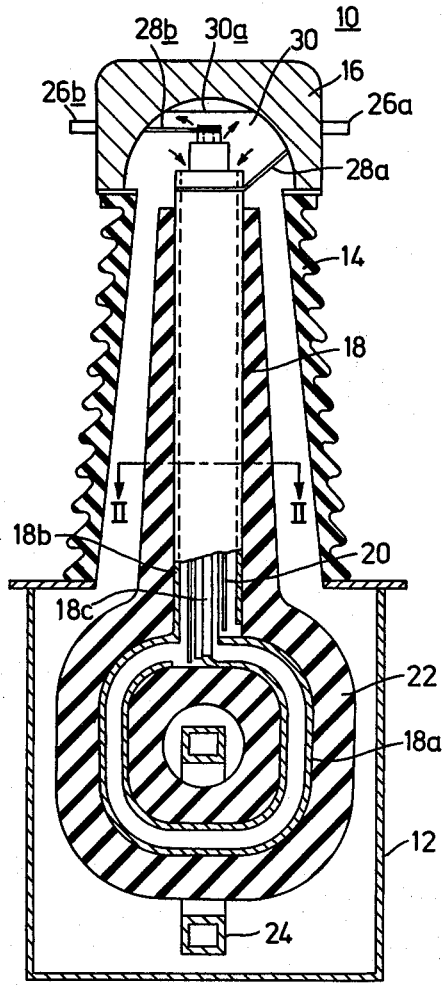
FIG. 1 is a longitudinal sectional view of one embodiment according to the current transformer of the present invention with parts illustrated in elevation.

Referring now to FIG. 1 of the drawing, there is illustrated one embodiment according to the current transformer of the present invention. The arrangement illustrated comprises a housing (envelope) generally designated by the reference numeral 10 including a lower tank 12, a porcelain tube 14 and an upper tank 16 connected to one another in the named order. The embodiment also comprises a primary winding 18 including a tubular electrically conducting coil 18*a* having a single turn, and a pair of lead-in wires rectilinearly extending from both ends of the coil 18*a*. The lead-in wires include an outer tubular electrically conducting member 18*b* of a circular cross section connected to one end of the coil 18*a*, an inner electrically conducting member 18*c* coaxially disposed within the outer tubular electrically conducting member 18*b* and connected to the other end of the coil 18*a*, and a hollow cylindrical dielectric member 20 disposed in coaxial relationship between the outer tubular electrically conducting member 18*b* and the inner electrically conducting member 18*c* to axially divide the interior of the tubular member 18*b* into an incoming annular flow path defined by the tubular member 18*b* and the dielectric member 20 and an outgoing annular flow path defined by the dielectric member 20 and the inner electrically conducting member 18*c*. The incoming and outgoing flow paths communicate with each other through a flow path defined by the tubular coil 18*a*.

Figure 2:
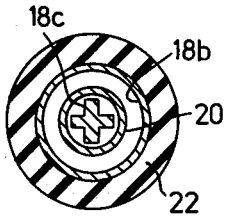
FIG. 2 is a cross-sectional view of the arrangement shown in FIG. 1 as viewed on the line II—II of FIG. 1.

According to the present invention, the inner electrically conducting member 18*c* is different in cross-sectional profile from the outer tubular electrically conducting member 18*b* (noncircular). In the example illustrated the inner electrically conducting member 18*c* is in a cruciform as best shown in FIG. 2. Then the tubular coil 18*a* and the tubular member 18*b* are wrapped in a electrically insulating member 22 except for the upper end portion of the tubular member 18*b*.

Further a secondary winding 24 in the form of a solenoid is magnetically interlinked with the tubular coil 18*a* through the electrically insulating member 22 as shown in FIG. 1.

Then the lower tank 12 has disposed therein the tubular coil 18*a* of the primary winding 18, that portion of the electrically insulating member 22 wrapping the same and the secondary winding 24 and the porcelain tube 14 has coaxially disposed therein the tubular electrically conducting member 18*b* the substantial portion of which is wrapped in the electrically insulating member 22. The upper end portion of the tubular member 18*b* is not wrapped in the electrically insulating member 22 as described above and reaches the upper tank 16. As shown in FIG. 1, the cylindrical dielectric member 20 extends somewhat beyond the the upper end of the outer tubular member 18*b* and the inner cruciform member 18*c* extends somewhat beyond the upper end of the dielectric member 12.

The upper tank 16 includes a pair of opposite terminals 26*a* and 26*b* extended and sealed through a peripheral wall of the upper tank 16 and connected to the outer tubular member 18*b* and the inner cruciform member 18*c* through leads 28*a* and 28*b* respectively.

The envelope 10 is filled with an amount of an dielectric fluid 30 whose level 30*a* lies in the upper tank 16. To this end, the upper tank 16 is constructed so that the dielectric fluid 30 is prevented from leaking therethrough.

Since the dielectric fluid 18 has its level 30*a* above the upper end of the cruciform member 20 as shown in FIG. 1, the dielectric fluid 30 is also charged in the outgoing flow path between the dielectric member 20 and the cruciform member 18*c*, the interior of the tubular coil 18*a* and the incoming flow path between the tubular member 18*b* and the dielectric member 20.

In operation the primary winding 18 generates heat and particularly the inner cruciform member 18*c* becomes hotter than the outer tubular member 18*b*. Thus a temperature difference is developed between that portion of the dielectric fluid 30 located within the dielectric member 20 and that located between the outer tubular member 18*b* and the dielectric member 20, resulting in the occurrence of the thermal syphon operation. In other words, the dielectric fluid 30 at an elevated temperature ascends along the outgoing flow path between the dielectric member 20 and the cruciform member 18*c* until it is delivered to the interior of the upper tank 16 where it dissipates its heat to the air through the peripheral wall of the upper tank 16 to be cooled. The dielectric fluid 30 thus cooled descends along the incoming flow path to reach the primary coil to cool it. The process as described above is repeated to continuously cool the primary winding 18.

Under these circumstances, the inner electrically conducting member 18*c* makes it possible to have a surface area of the heat exchange with respect to the dielectric fluid sufficiently large as compared with an inner one of a conventional outer and inner coaxial electrically conducting members as described above. Therefore the thermal syphon operation can be more effectively performed resulting in an enhancement of the cooling effect. This permits current transformers to be manufactured over a wide range of the design. Also the resulting current transformer can be smaller in size with a primary current remaining unchanged.

While the present invention has been illustrated and described in conjunction with the cruciform electrically conducting member it is to be understood that the same is not restricted thereby or thereto and that numerous changes and modifications may be resorted to without departing from the spirit and scope of the present invention. For example, the inner electrically conducting member 18*c* may have any desired cross-sectional profile other than that illustrated so far as the inner member has a cross-sectional profile sufficiently larger in surface area of heat exchange with respect to the dielectric fluid than the inner wall of the hollow cylindrical dielectric member.

What is claimed is:

1. A current transformer comprising a housing, an amount of a dielectric fluid disposed in said housing, a primary winding in the form of a tubular electrically conducting coil including a single turn, an outer tubular electrically conducting member having an outer member end connected at said outer member end to one end of said coil and communicating with the interior thereof, an inner electrically conducting member different in cross-sectional profile from said outer tubular electrically conducting member and coaxially disposed within said outer tubular electrically conducting member, connected at said outer member end to the other end of said coil, a hollow cylindrical dielectric member coaxially disposed within and radially spaced from said outer tubular electrically conducting member to surround said inner electrically conducting member in radially spaced relation thereto to form an incoming flow path for said dielectric fluid between said outer tubular electrically conducting member and said hollow cylindrical dielectric member and an outgoing flowing path for said dielectric fluid between said hollow cylindrical dielectric member and said inner electrically conducting member respectively, said incoming and outgoing flow paths communicating with each other through the interior of said tubular coil, an electrically insulating member wrapping said primary winding and said outer tubular electrically conducting member, and a secondary winding in the form of a solenoid magnetically interlinked with said primary winding through said electrically insulating member, said current transformer being immersed in said dielectric fluid with said incoming and outgoing flow paths and the interior of said primary winding being charged with said dielectric fluid.

2. A current transformer as claimed in claim 1 wherein said inner electrically conducting member has a cruciform cross section.

3. A current transformer as claimed in claim 1, wherein said inner electrically conductive member has a radially exterior surface area which is substantially larger per unit length than the interior surface of said outer tubular electrically conducting member.

* * * * *